US005461803A

United States Patent [19]

Rocke

[11] Patent Number: 5,461,803

[45] Date of Patent: Oct. 31, 1995

[54] SYSTEM AND METHOD FOR DETERMINING THE COMPLETION OF A DIGGING PORTION OF AN EXCAVATION WORK CYCLE

[75] Inventor: David J. Rocke, Eureka, Ill.

[73] Assignee: Caterpillar Inc., Peoria, Ill.

[21] Appl. No.: 217,034

[22] Filed: Mar. 23, 1994

[51] Int. Cl.[6] ..... E02F 3/32

[52] U.S. Cl. ..... 37/443; 364/424.07; 414/699

[58] Field of Search ..... 37/443, 348; 414/694, 414/699, 708; 364/424.07, 167.01; 172/4.5

[56] References Cited

U.S. PATENT DOCUMENTS

| | | | |
|---|---|---|---|
| 3,505,514 | 4/1970 | Fathauer | 364/424.07 |
| 3,583,585 | 6/1971 | Joyce | 214/138 |
| 3,586,184 | 6/1971 | Pesavento et al. | 214/136 |
| 3,740,534 | 6/1973 | Kezer et al. | 364/424.07 |
| 3,819,922 | 6/1974 | Horn et al. | 364/424.07 |
| 4,185,280 | 1/1980 | Wilhelm | 364/424.07 X |
| 4,332,517 | 6/1982 | Igarashi et al. | 414/699 |
| 4,377,043 | 3/1983 | Inui et al. | 38/18 R |
| 4,576,053 | 3/1986 | Hatamura | 73/862.66 |
| 4,807,136 | 2/1989 | Rutkowski et al. | 364/424.07 |
| 4,910,673 | 3/1990 | Narisawa et al. | 364/424.07 |
| 5,002,454 | 3/1991 | Hadank et al. | 414/695.5 |
| 5,065,320 | 11/1991 | Hayashi et al. | 364/424.07 X |
| 5,065,326 | 11/1991 | Sahm | 364/424.07 |
| 5,116,186 | 5/1992 | Hanamoto et al. | 414/694 |
| 5,128,599 | 7/1992 | Nikolaus et al. | 318/685 |
| 5,160,239 | 11/1992 | Allen et al. | 414/699 |
| 5,178,510 | 1/1992 | Hanamoto et al. | 414/694 |
| 5,218,895 | 6/1992 | Lukich et al. | 91/361 |
| 5,347,448 | 9/1994 | Nam | 414/699 X |
| 5,356,259 | 10/1994 | Hanamoto et al. | 37/348 X |
| 5,361,211 | 11/1994 | Lee et al. | 414/699 X |

OTHER PUBLICATIONS

"A Laboratory Study of Force–Cognitive Excavation", D. M. Bullock et al, Jun. 6–8, 1989, Proceedings of the Sixth International Symposium on Automation and Robotics in Construction.

"A Microcomputer–Based Agricultural Digger Control System", E. R. I. Deane et al., Dec. 20, 1988, Computers and Electronics in Agriculture (1989), Elsevier Science Publishers.

"Artificial Intelligence in the Control and Operation of Construction Plant–The Autonomous Robot Excavator", D. A. Bradley et al., Automation in Construction 2 (1993), Elsevier Science Publishers B.V.

"Control and Operational Strategies for Automatic Excavation" D. A. Bradley et al., Proceedings of the Sixth International Symposium on Automation and Robotics in Construction, Jun. 6–8, 1989.

"Development of Unmanned Wheel Loader System–Application to Asphalt Mixing Plant", H. Ohshima et al., Published by Komatsu, Nov. 1992.

(List continued on next page.)

*Primary Examiner*—Randolph A. Reese
*Assistant Examiner*—Victor Batson
*Attorney, Agent, or Firm*—David M. Masterson; Thomas J. Bluth

[57] ABSTRACT

A control system for automatically controlling a work implement of an excavating machine through a machine work cycle is disclosed. The work implement includes a boom, stick and bucket, each being controllably actuated by at least one respective hydraulic cylinder. A position sensor produces respective position signals in response to the respective position of the boom, stick and bucket. A pressure sensor produces respective pressure signals in response to the associated hydraulic pressures associated with the boom, stick, and bucket hydraulic cylinders. A microprocessor receives the position and pressure signals, and produces a command signal. An electrohydraulic system receives the command signal and controllably actuates predetermined ones of the hydraulic cylinders to perform the work cycle. The microprocessor determines the external force applied to the bucket and the angle of the bucket force, compares the angle of the bucket force to a predetermined value, and responsively determines when a digging portion of the work cycle is complete.

12 Claims, 7 Drawing Sheets

OTHER PUBLICATIONS

"Motion and Path Control for Robotic Excavation", L. E. Bernold, Sep., 1990, Submitted to the ASCE Journal of Aerospace Engrg.

"Design of Automated Loading Buckets", P. A. Mikhirev, pp. 292–298, Institute of Mining, Siberian Branch of the Academy of Sciences of the USSR, Nevosibirsk. Translated from Fiziko–Tekhnicheskie Problemy Razrabotki Poleznykh Iskopaemykh, No. 4, pp. 79–86, Jul.–Aug., 1986. Original Article Submitted Sep. 28, 1984, Plenum Publishing Corporation, 1987.

"Method of Dipper Filling Control for a Loading–Transporting Machine Excavating Ore in Hazardous Locations", V. L. Konyukh et al., pp. 132–138, Institute of Coal, Academy of Sciences of the USSR, Siberian Branch, Kemorovo. Translated form Fiziko–Tekhnicheskie Problemy Razrabotki Poleznykh Iskopaemykh, No. 2, pp. 67–73, Mar.–Apr., 1988. Original Article Submitted Jun. 18, 1987, Plenum Publishing Corporation, 1989.

"Automated Excavator Study", James G. Cruz, A Special Research Problem Presented to the Faculty of the Construction Engineering and Management Program, Purdue University, Jul. 23, 1990.

"Just Weigh It and See", Mike Woof, p. 27, Construction News, Sep. 9, 1993.

"An Intelligent Task Control System for Dynamic Mining Environments", Paul J. A. Lever et al., pp. 1–6, Presented at 1994 SME Annual Meeting, Albuquerque, N.M., Feb. 14'17, 1994.

"Cognitive Force Control of Excavators", P. K. Vaha et al., pp. 159–166, The Manuscript for this Paper was Submitted for Review and Possible Publication on Oct. 9, 1990. This Paper is Part of the Journal of Aerospace Engineering, vol. 6, No. 2, Apr. 1993.

SYSTEM AND METHOD FOR DETERMINING THE COMPLETION OF A DIGGING PORTION OF AN EXCAVATION WORK CYCLE

TECHNICAL FIELD

This invention relates generally to the field of excavation and, more particularly, to a system and method for determining the completion of a digging portion of an excavation work cycle.

BACKGROUND ART

Work machines such as excavators, backhoes, front shovels, and the like are used for excavation work. These excavating machines have work implements which consist of boom, stick and bucket linkages. The boom is pivotally attached to the excavating machine at one end, and to its other end is pivotally attached a stick. The bucket is pivotally attached to the free end of the stick. Each work implement linkage is controllably actuated by at least one hydraulic cylinder for movement in a vertical plane. An operator typically manipulates the work implement to perform a sequence of distinct functions which constitute a complete excavation work cycle.

In a typical work cycle, the operator first positions the work implement at a dig location, and lowers the work implement downward until the bucket penetrates the soil. Then the operator executes a digging stroke which brings the bucket toward the excavating machine. The operator subsequently curls the bucket to capture the soil. To dump the captured load the operator raises the work implement, swings it transversely to a specified dump location, and releases the soil by extending the stick and uncurling the bucket. The work implement is then returned to the trench location to begin the work cycle again. In the following discussion, the above operations are referred to respectively as boom-down-into-ground, dig-stroke, capture-load, swing-to-dump, dump-load, and return-to-trench.

The earthmoving industry has an increasing desire to automate the work cycle of an excavating machine for several reasons. Unlike a human operator, an automated excavating machine remains consistently productive regardless of environmental conditions and prolonged work hours. The automated excavating machine is ideal for applications where conditions are dangerous, unsuitable or undesirable for humans. An automated machine also enables more accurate excavation making up for the lack of operator skill.

The present invention is directed to overcoming one or more of the problems as set forth above.

DISCLOSURE OF THE INVENTION

In one aspect of the present invention, a control system for automatically controlling a work implement of an excavating machine through a machine work cycle is disclosed. The work implement includes a boom, stick and bucket, each being controllably actuated by at least one respective hydraulic cylinder. A position sensor produces respective position signals in response to the respective position of the boom, stick and bucket. A pressure sensor produces respective pressure signals in response to the associated hydraulic pressures associated with the boom, stick, and bucket hydraulic cylinders. A microprocessor receives the position and pressure signals, and produces a command signal. An electrohydraulic system receives the command signal and controllably actuates predetermined ones of the hydraulic cylinders to perform the work cycle. The microprocessor determines the external force applied to the bucket and the angle of the bucket force, compares the angle of the bucket force to a predetermined value, and responsively determines when a digging portion of the work cycle is complete.

BRIEF DESCRIPTION OF THE DRAWINGS

For a better understanding of the present invention, reference may be made to the accompanying drawings in which.

BEST MODE FOR CARRYING OUT THE INVENTION

Figure 1A:
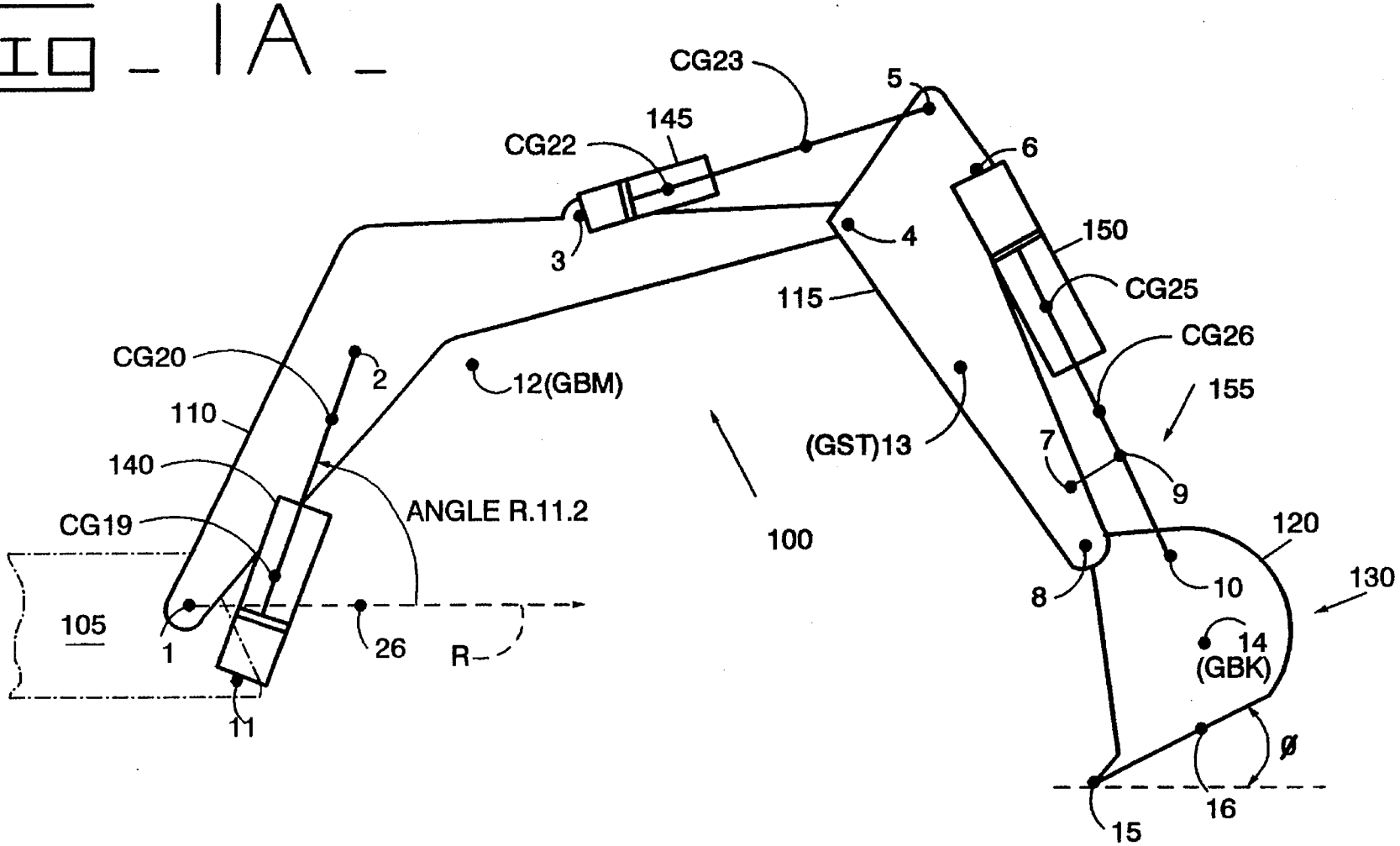
FIGS. 1A, 1B are a diagrammatic views of a work implement of an excavating machine.
Figure 1B:
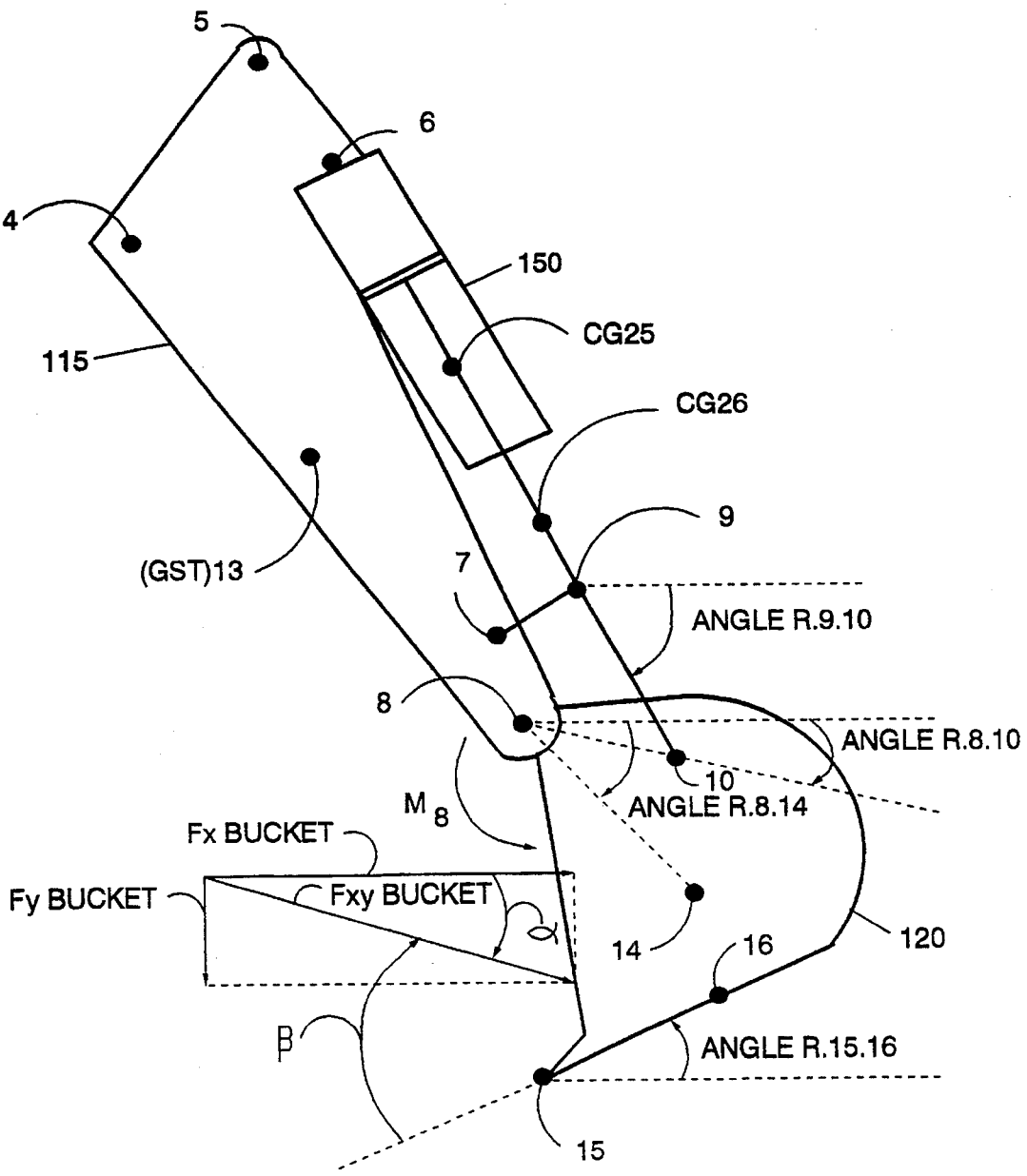

With reference to the drawings, FIG. 1 shows a planar view of a work implement 100 of an excavating machine, which performs digging or loading functions similar to that of an excavator, backhoe loader, and front shovel.

The excavating machine may include an excavator, power shovel, wheel loader or the like. The work implement 100 may include a boom 110 stick 115, and bucket 120. The boom 110 is pivotally mounted on the excavating machine 105 by boom pivot pin 1. The center of gravity of the boom (GBM) is represented by point 12. The stick 115 is pivotally connected to the free end of the boom 110 at stick pivot pin 4. The center of gravity of the stick (GST) is represented by point 13. The bucket 120 is pivotally attached to the stick 115 at bucket pivot pin 8. The bucket 120 includes a rounded portion 130, a floor designated by point 16, and a tip designated by point 15. The center of gravity of the bucket (GBK) is represented by point 14.

A horizontal reference axis, R, is defined having an origin at pin 1 extending through point 26. The axis, R, is used to measure the relative angular relationship between the work vehicle 105 and the various pins and points of the work implement 100.

The boom 110, stick 115 and bucket 120 are independently and controllably actuated by linearly extendable hydraulic cylinders. The boom 110 is actuated by at least one boom hydraulic cylinder 140 for upward and downward movements of the stick 115. The boom hydraulic cylinder 140 is connected between the work machine 105 and the boom 110 at pins 11 and 2. The center of gravities of the boom cylinder and cylinder rod are represented by points CG19,CG20, respectively. The stick 115 is actuated by at least one stick hydraulic cylinder 145 for longitudinal horizontal movements of the bucket 120. The stick hydraulic cylinder 145 is connected between the boom 110 and the stick 115 at pins 3 and 5. The center of gravities of the stick cylinder and cylinder rod are represented by points CG22, CG23, respectively. The bucket 120 is actuated by a bucket hydraulic cylinder 150 and has a radial range of motion about the bucket pivot pin 8. The bucket hydraulic cylinder 150 is connected to the stick 115 at pin 6 and to a linkage 155 at pin 9. The linkage 155 is connected to the stick 115 and the bucket 120 at pins 7 and 10, respectively. The center of gravities of the bucket cylinder and cylinder rod are represented by points CG25,CG26, respectively. For the purpose of illustration, only one boom, stick, and bucket hydraulic cylinder 140,145,150 is shown in FIG. 1.

To ensure an understanding of the operation of the work implement 100 and hydraulic cylinders 140,145,150 the following relationship is observed. The boom 110 is raised by extending the boom cylinder 140 and lowered by retracting the same cylinder 140. Retracting the stick hydraulic cylinders 145 moves the stick 115 away from the excavating machine 105, and extending the stick hydraulic cylinders 145 moves the stick 115 toward the machine 105. Finally, the bucket 120 is rotated away from the excavating machine 105 when the bucket hydraulic cylinder 150 is retracted, and rotated toward the machine 105 when the same cylinder 150 is extended.

Figure 2:
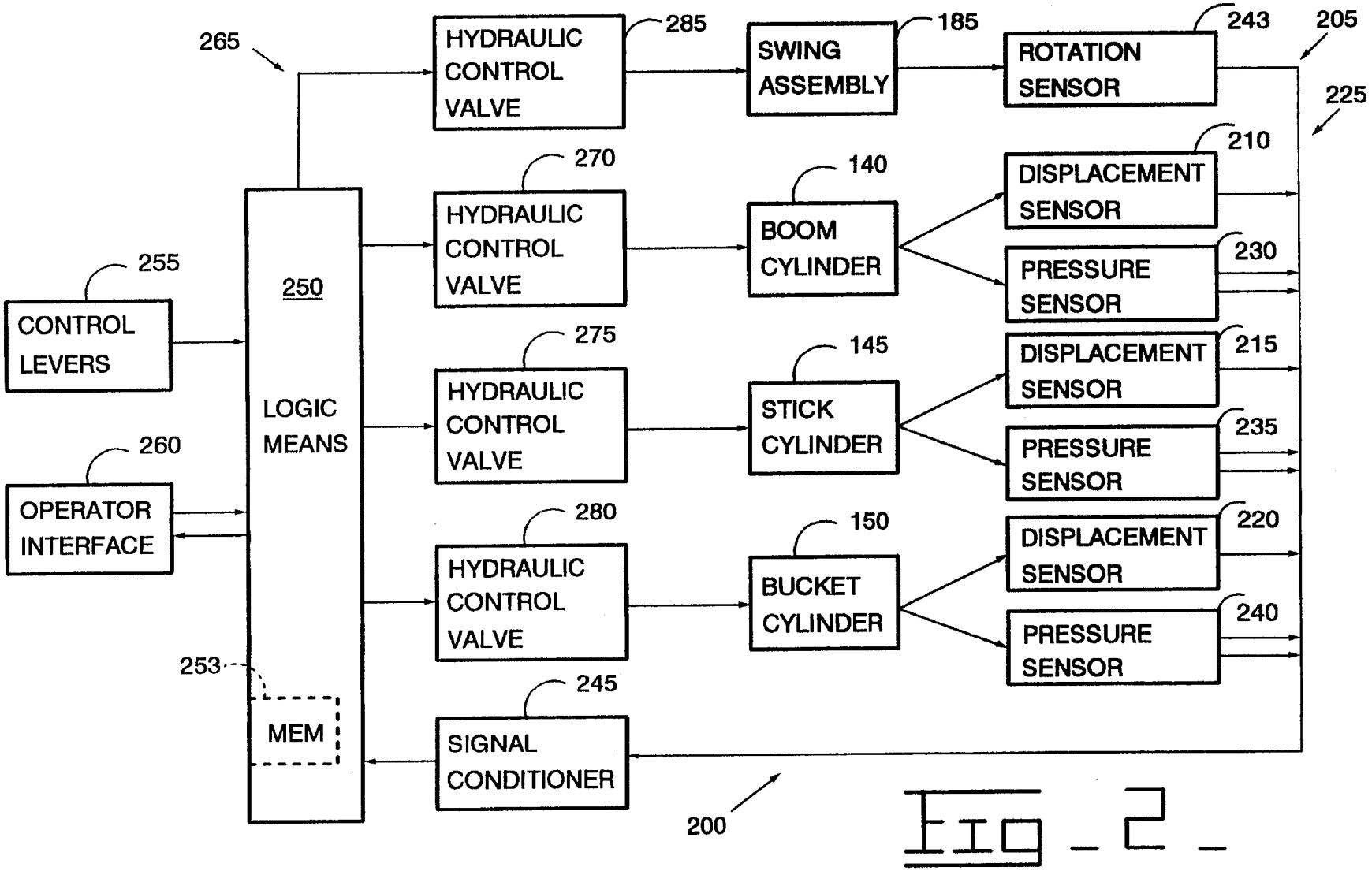
FIG. 2 is a hardware block diagram of a control system of the excavating machine.

Referring now to FIG. 2, a block diagram of an electro-hydraulic system 200 associated with the present invention is shown. A means 205 produces position signals in response to the position of the work implement 100. The means 205 includes displacement sensors 210,215,220 that sense the amount of cylinder extension in the boom, stick and bucket hydraulic cylinders 140,145,150 respectively. A radio frequency based sensor described in U.S. Pat. No. 4,737,705 issued to Bitar et al. on Apr. 12, 1988 may be used.

It is apparent that the work implement 100 position is also derivable from the work implement joint angle measurements. An alternative device for producing a work implement position signal includes rotational angle sensors such as rotatory potentiometers, for example, which measure the angles between the boom 110, stick 115 and bucket 120. The work implement position may be computed from either the hydraulic cylinder extension measurements or the joint angle measurement by trigonometric methods. Such techniques for determining bucket position are well known in the art and may be found in, for example, U.S. Pat. No. 3,997,071 issued to Teach on Dec., 14, 1976 and U.S. Pat. No. 4,377,043 issued to Inui et al. on Mar. 22, 1983.

A means 225 produces a pressure signal in response to the force exerted on the work implement 100. The means 225 includes pressure sensors 230,235,240 which measure the hydraulic pressures in the boom, stick, and bucket hydraulic cylinders 140,145,150 respectively. The pressure sensors 230,235,240 each produce signals responsive to the pressures of the respective hydraulic cylinders 140,145,150. For example, cylinder pressure sensors 230,235,240 sense boom, stick and bucket hydraulic cylinder head and rod end pressures, respectively. A suitable pressure sensor is provided by Precise Sensors, Inc. of Monrovia, Calif. in their Series 555 Pressure Transducer, for example.

A swing angle sensor 243, such as a rotary potentiometer, located at the work implement pivot point 180, produces an angle measurement corresponding to the amount of work implement rotation about the swing axis, Y, relative to the dig location.

The position and pressure signals are delivered to a signal conditioner 245. The signal conditioner 245 provides conventional signal excitation and filtering. A Vishay Signal Conditioning Amplifier 2300 System manufactured by Measurements Group, Inc. of Raleigh, N.C. may be used for such purposes, for example. The conditioned position and pressure signals are delivered to a logic means 250. The logic means 250 is a microprocessor based system which utilizes arithmetic units to control process according to software programs. Typically, the programs are stored in read-only memory, random-access memory or the like. The programs are discussed in relation to various flowcharts.

The logic means 250 includes inputs from two other sources: multiple joystick control levers 255 and an operator interface 260. The control lever 255 provides for manual control of the work implement 100. The output of the control lever 255 determines the work implement 100 movement direction and velocity.

A machine operator may enter excavation specifications such as excavation depth and floor slope through an operator interface 260 device. The operator interface 260 may also display information relating to the excavating machine payload. The interface 260 device may include a liquid crystal display screen with an alphanumeric key pad. A touch sensitive screen implementation is also suitable. Further, the operator interface 260 may also include a plurality of dials and/or switches for the operator to make various excavating condition settings.

The logic means 250 receives the position signals and responsively determines the velocities of the boom 110, stick 115, and bucket 120 using well known differentiation techniques. It will be apparent to those skilled in the art that separate velocity sensors may be equally employed to determine the velocities of the boom, stick and bucket.

The logic means 250 additionally determines the work implement geometry and forces in response to the position and pressure signal information.

For example, the logic means 250 receives the pressure signals and computes boom, stick, and bucket cylinder forces, according to the following formula:

$$\text{cylinder force}=(P_2*A_2)-(P_1*A_1)$$

where $P_2$ and $P_1$ are respective hydraulic pressures at the head and rod ends of a particular cylinder 140,145,150, and $A_2$ and $A_1$ are cross-sectional areas at the respective ends.

The logic means 250 produces boom, stick and bucket cylinder command signals for delivery to an actuating means 265 which controllably moves the work implement 100. The actuating means 265 includes hydraulic control valves 270, 275,280 that controls the hydraulic flow to the respective boom, stick and bucket hydraulic cylinders 140,145,150. The actuating means 265 also includes a hydraulic control valve 285 that controls the hydraulic flow to the swing assembly 185.

Figure 3:
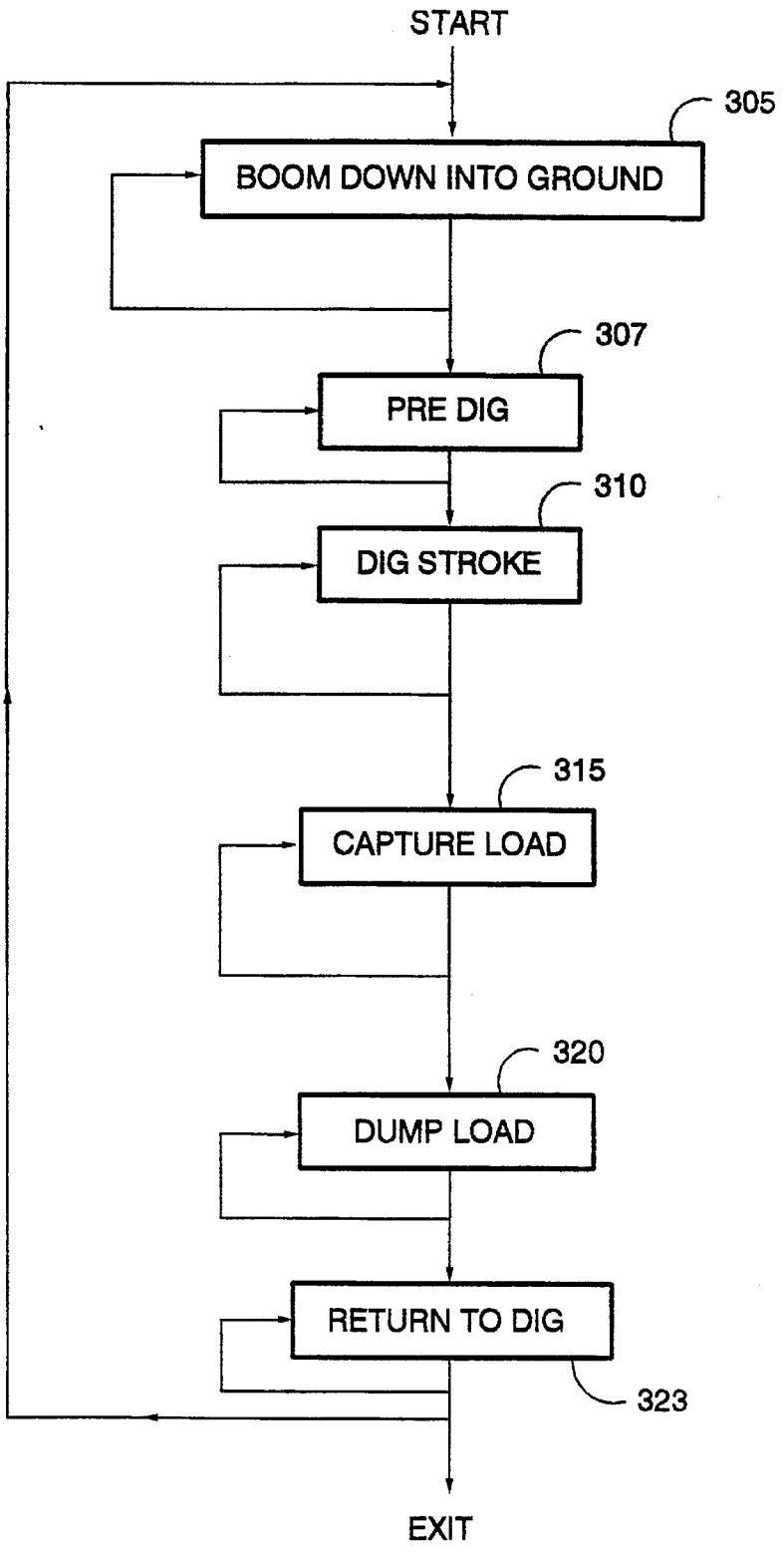
FIG. 3 is a top level flowchart representing the control of an excavation work cycle.

Referring now to FIG. 3, a flow diagram of an automated excavation work cycle is shown. The work cycle for an excavating machine 105 can generally be partitioned into six distinctive and sequential functions: boom-down-into-ground 305, pre-dig 307, dig-stroke 310, capture-load 315, dump-load 320, and return-to-dig 323.

The present invention includes an embodiment of the dig-stroke function 310, and more particularly to determining when the dig-stroke or digging function is complete. Therefore, only the dig-stroke function 310 will be discussed in detail, as a discussion of the other functions are not critical to the present invention. However, for a greater discussion of the other functions, the reader is referred to Applicant's application entitled "Automatic Excavation Control System and Method" (Atty. Docket No. 93-328), now Ser. No. 08/216,386, which was filed on the same date as the present application and is hereby incorporated by reference.

Figure 5:
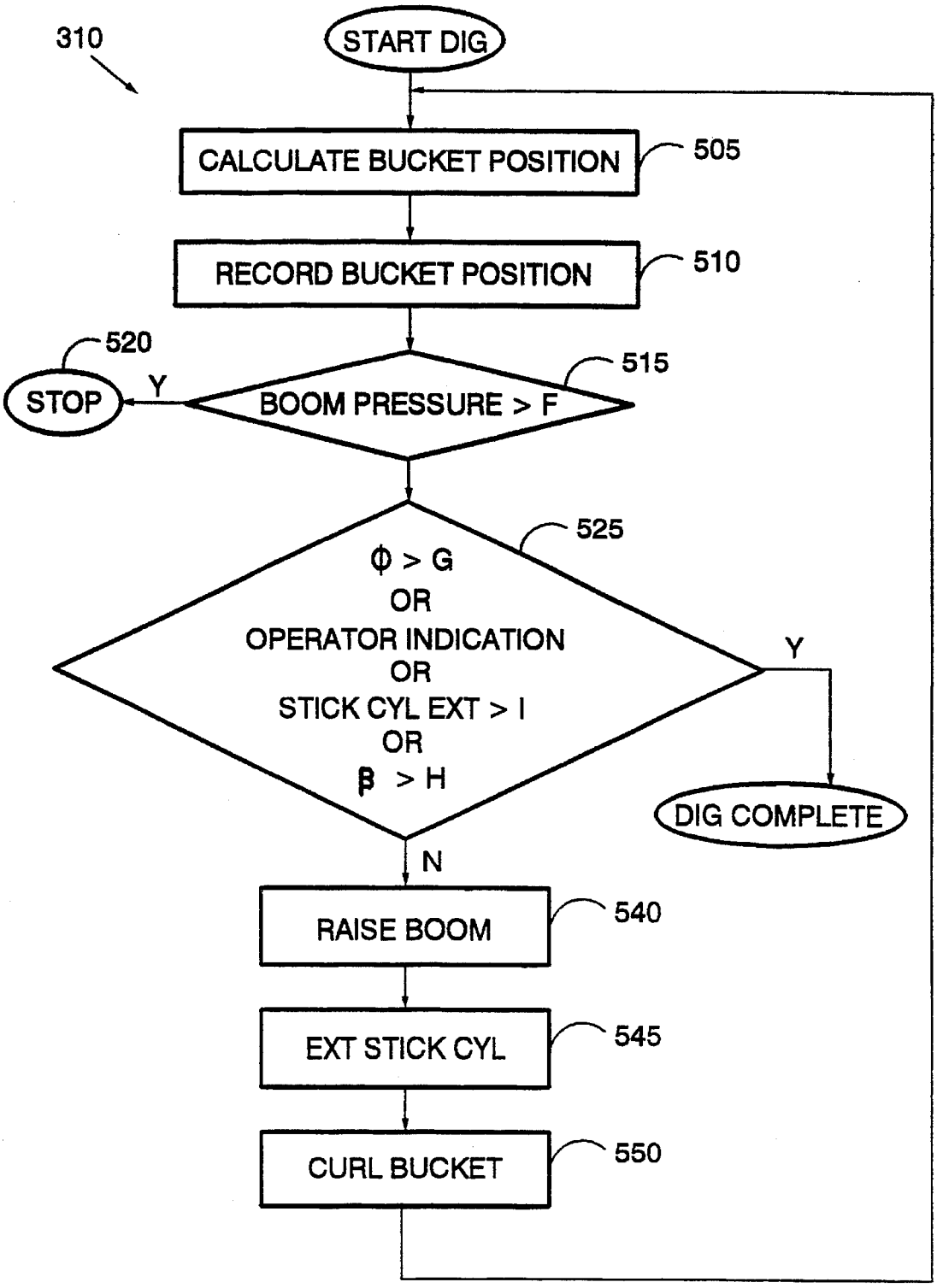
FIG. 5 is a second level flowchart of representing the control of the digging portion of the work cycle.

Reference is now made to FIG. 5, which illustrates the control of the dig-stroke function 310. The dig-stroke function 310 moves the bucket 120 along the ground toward the excavating machine 105. The dig-stroke function begins by calculating the bucket position at block 505. The term "bucket position" refers to the bucket tip position, together with the bucket angle $\phi$, as shown in FIG. 1. The bucket position is calculated in response to the position signals. The bucket position may be calculated by various methods that are well known in the art. As the digging cycle continues, the bucket 120 may extend deeper into the ground. Consequently, the control records the position of the bucket 120 as it extends deeper into the ground at block 510. In decision block 515, the boom cylinder pressure is compared to a setpoint F. If the boom cylinder pressure exceeds setpoint F, the machine is said to be unstable and may tip. Accordingly, if the boom cylinder pressure exceeds setpoint F, then program control stops as shown by block 520. Otherwise, control continues to decision block 525. Note that, the value of setpoint F may be obtained from a table of pressure values that correspond to a plurality of values representing excavator instability for various geometries of the work implement 100.

The excavating machine 105 performs the dig-stroke or digging portion of the work cycle by bringing the bucket 120 toward the excavating machine. Decisional block 525 indicates when the dig-stroke is complete. First, the bucket angle $\phi$ is compared to a setpoint G, which represents a predetermined bucket curl associated with a desired amount of bucket fill. Second, the program control determines if the operator has indicated that digging should cease, via the operator interface 260, for example. Third, the stick cylinder position is compared to a setpoint I, which indicates dig-stroke completion. Setpoint I represents a maximum stick cylinder extension for digging. Finally, the angle of the bucket force, $\beta$ is compared to a setpoint H. For example, setpoint H represents an angular value that is typically zero. If, for example, $\beta$ is lesser than setpoint H, then the bucket is said to be heeling. Heeling occurs when the net force on the bucket is imposed on the underside of the bucket, which indicates that no more material may be captured by the bucket.

Figure 6:
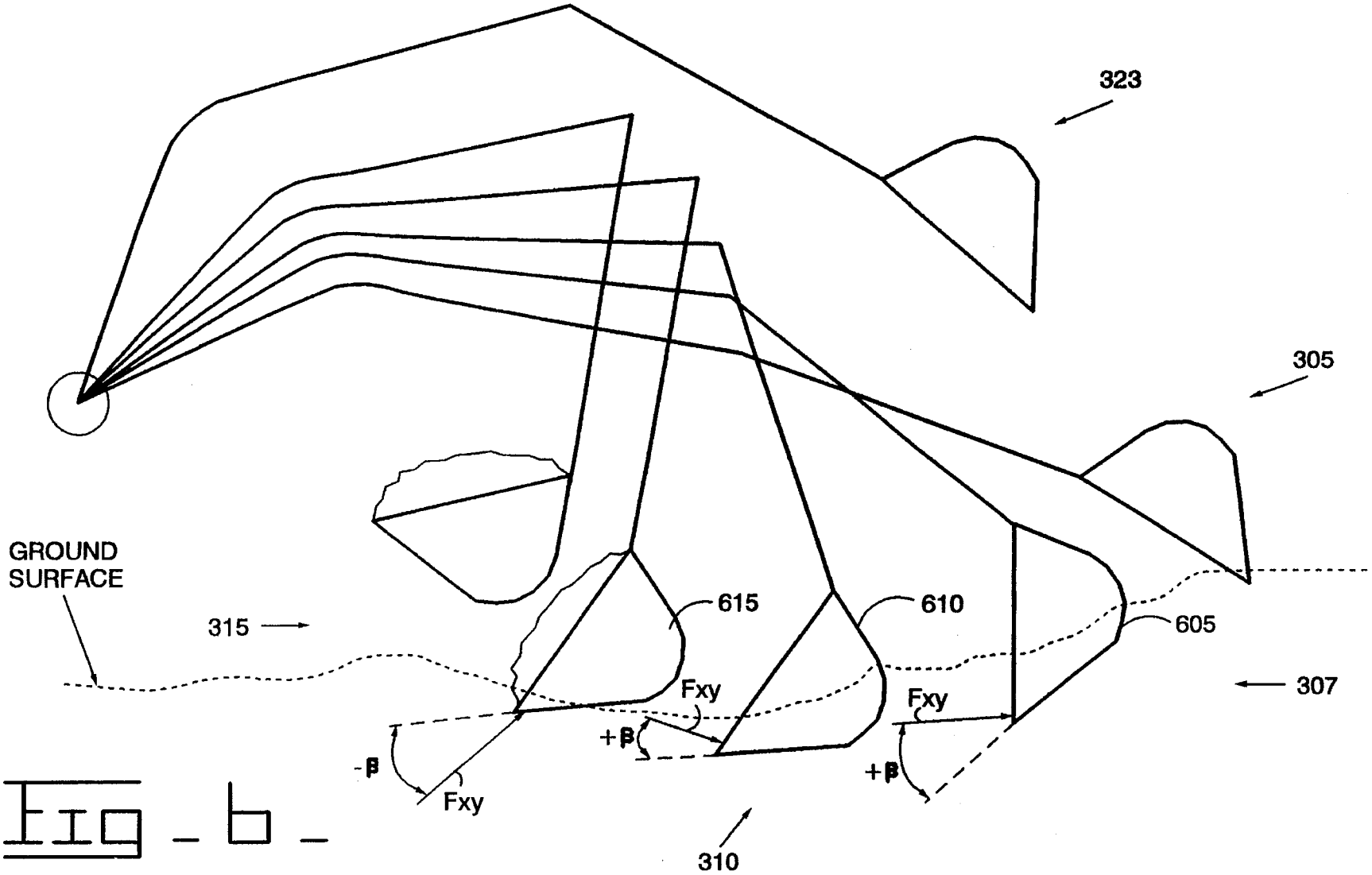
FIG. 6 is a diagrammatic view of the work implement during various stages of the excavation work cycle.

To better illustrate how the present invention determines bucket heeling, reference is made to FIG. 6, which illustrates various positions of the work implement 100 at various portions of the excavator work cycle. Note that, the angle of the bucket force, $\beta$, is referenced from a line extending from the bucket floor. At position 605, digging starts. As shown, $\beta$ has a largely positive value, which represents that the resultant force vector on the bucket 120 is located at a good digging position. At position 610, $\beta$ becomes smaller as the work implement is brought toward the excavating machine. At position 615, $\beta$, becomes negative. This illustrates that the bucket is heeling, which is a poor digging position because the resultant force on the bucket is located at the underside of the bucket.

If any one of the conditions of block 525 occur, then the digging portion of the work cycle is complete.

If digging is not complete, then the dig-stroke function continues to block 540 where the work produced by the stick and bucket cylinders 145,150 during the prior pass is calculated and stored. Next, at blocks 540,595,550, the boom 110 is raised, the stick 115 is brought toward the machine, and the bucket is curled by extending the respective cylinders 140,145,150.

The following discussion pertains to how the angle of the bucket force, $\beta$, as well as, the magnitude and direction of the bucket force is calculated. Reference is made to the diagrammatic views of the work implement in FIGS. 1A and 1B. First, the logic means 250 determines the work implement geometry relative to the reference axis, R, in response to position information. The relative location of predetermined ones of the pins, points and center of gravities are calculated using well known geometric and trigonometric laws. For example, the work implement geometry may be determined by using the inverse trig functions, the law of sines and cosines, and their inverses. Further, the various forces on predetermined ones of the pins may be determined in response to position and pressure information. For example, the location and magnitude of the forces on the pins may be determined by using two-dimensional vector cross and dot products. It should be noted that the work implement geometry and force information may be determined by several methods well understood by those skilled in the art. For example, the various forces on the pins may be directly measured by using strain gauges or other structural load measurement methods.

Note, for the following description, the term "angle R.X.Y" represents the angle in radians between a line parallel to the reference axis, R, and the line defined by pins X and Y. The term "length X.Y" represents the length between points X and Y.

First, the sum of the forces on the boom-stick-bucket in the x-direction is determined in the following manner:

$$\Sigma F_X \text{ boom-stick-bucket} = F_X \text{ BUCKET} + F_X \text{ pin } 1 + F_X \text{ pin } 2 = 0 \quad (1)$$

where, $F_X$ BUCKET is the external force applied to the bucket in the x-direction;

$F_X$ pin 1 represents the force applied to pin 1 in the x-direction, which may be determined by summing the forces on the boom at pin 1; and $F_X$ pin 2 represents the force applied to pin 2 in the x-direction, which is due to the axial force in the boom cylinder.

Rearranging equation (1) and solving for the force component, $F_X$ BUCKET, equation (1) is simplified as:

$$F_X \text{ BUCKET} = -F_X \text{ pin } 1 - (\text{axial force in the boom cylinder}) * \cos(\text{angle R.11.2})$$

Second, the sum of the forces on the boom-stick-bucket in the y-direction may be calculated in a similar manner.

$$\Sigma F_Y \text{ boom-stick-bucket} = F_Y \text{ BUCKET} + F_Y \text{ pin } 1 + F_Y \text{ pin } 2 - \text{the weights of linkage components} = 0 \quad (2)$$

where, $F_Y$ BUCKET is the external force applied to the bucket in the y-direction;

$F_Y$ pin 1 represents the force applied to pin 1 in the y-direction, which may be determined by summing the forces on the boom at pin 1; and $F_Y$ pin 2 represents the force applied to pin 2 in the y-direction, which is due to the axial force in the boom cylinder.

Rearranging equation (2) and solving for the force component, $F_Y$ BUCKET, equation (2) is shown as:

$$F_Y \text{ BUCKET} = -F_Y \text{ pin } 1 - (\text{axial force in the boom cylinder}) * \sin(\text{angle R.11.2}) + \Sigma\text{boom-stick-bucket weight} + (\text{the stick and bucket cylinder and rod weights}) + (\text{boom cylinder and rod weight at pin } 2)$$

The external force applied to the bucket, $F_{XY}$ is calculated according to:

$$F_{XY} = \sqrt{[(F_Y \text{ BUCKET})^2 + (F_X \text{ BUCKET})^2]}$$

Next the angle, β, of the external force applied to the bucket, $F_{XY}$, is calculated relative to the bucket floor in the following manner:

$$\beta = \text{angle of } F_{XY} \text{ relative to a reference line, } \alpha, -\text{angle R.15.16}$$

where, $$\alpha = \arctan(F_Y \text{ BUCKET}/F_X \text{ BUCKET})$$

To properly identify the quadrant where α resides, adjustment may made to α based on positiveness or negativeness of $F_X$ BUCKET and $F_Y$ BUCKET. For example, if $F_X$ BUCKET and $F_Y$ BUCKET have both negative values, then Π radians are subtracted from α. Moreover if $F_X$ BUCKET has a negative value, while $F_Y$ BUCKET has a positive value, then Π radians are added to α.

The moment arm of the external force on the bucket, MA BUCKET, may also provide desirable information, and is calculated about pin 8 by summing the moments about pin 8.

First, the force on the bucket normal to line 8.15, $F_N$ BUCKET, is calculated according to the following relationship:

$$F_N \text{ BUCKET} = F_{XY}*[(\cos(\alpha)*\cos(\text{angle R.15.16}+\Pi/2)) + (\sin(\alpha)*\sin(\text{angle R.15.16}+\Pi/2)]$$

Next, the moment about pin 8, $M_8$, is calculated according to:

$$M_8 = \text{length of 8.10*force on 9.10*[cos (angle R.8.10)*sin (angle R.9.10)}-\text{cos (angle R.9.10)*sin (angle R.8.10)]+length of 8.14*bucket weight*[cos (angle R.8.14)* sin (}-\Pi/2)-\text{cos (}-\Pi/2)\text{*sin (angle R.8.14)]}$$

Finally, the moment arm of the external force on the bucket, MA BUCKET, is calculated according to:

$$\text{MA BUCKET} = M_8/F_N\text{BUCKET}$$

Industrial Applicability

Figure 4:
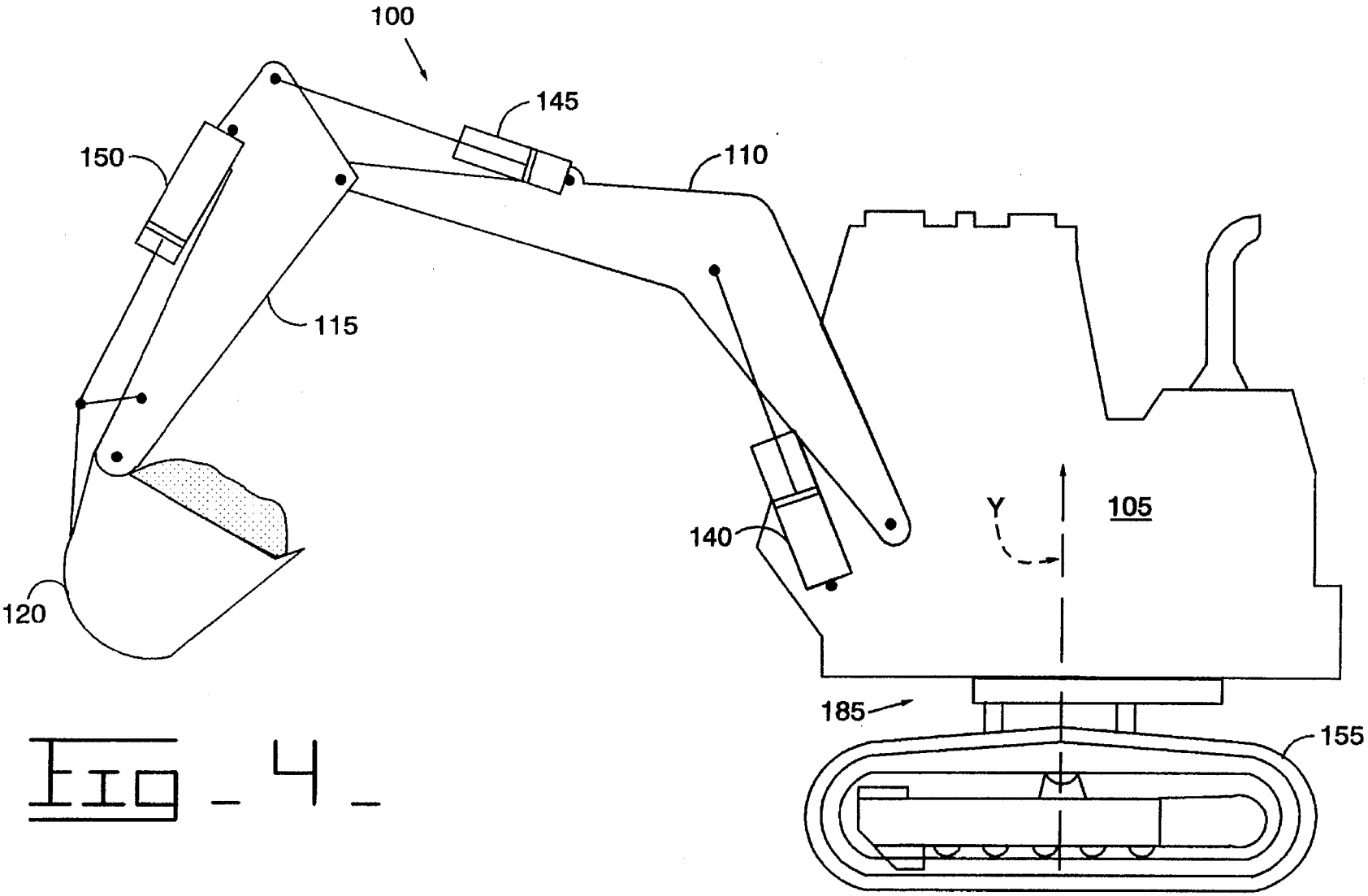
FIG. 4 is a side view of the excavating machine.

The operation of the present invention is best described in relation to its use in relation to its use in earthmoving vehicles, particularly those vehicles which perform digging or loading functions such as excavators, backhoe loaders, and front shovels. For example, a hydraulic excavator is shown in FIG. 4, where line Y is a vertical line of reference.

In an embodiment of the present invention, the excavating machine operator has at his disposal two work implement control levers and a control panel or operator interface 260. Preferably, one lever controls the boom 110 and bucket 120 movement, and the other lever controls the stick 115 and swing movement. The operator interface 260 provides for operator selection of operator options, entry of function specifications, and a graphical display of excavating conditions.

For an autonomous excavation operation, the operator is prompted for a desired dig depth, dig location, and dump location. Reference is now made to FIG. 6, which illustrates an excavation work cycle, which may augmented by operator controllability. For this illustration, assume that the bucket 120 has entered the ground. First, the logic means 250 initiates the pre-dig portion of the work cycle 307 by commanding the bucket 120 to curl at nearly full velocity until a predetermined cutting angle is reached. As the bucket curls, the boom 110 is raised at a predetermined velocity. Simultaneously, the stick 115 is commanded inward at a predetermined velocity.

Once the bucket 120 has curled to the predetermined cutting angle, the logic means 250 initiates the dig-stroke portion of the work cycle 310 by commanding the boom 110 to raise, while the bucket 120 is commanded to curl. The stick 115, however, is commanded at nearly full velocity to retrieve as much material from the ground as possible.

While the machine is excavating, the logic means 250 is continually performing the above force calculations. Because the external force applied to the bucket is readily calculated, the operator interface 260 may display the external force magnitude and direction. For example, the operator interface may show a graphical display of the external force, and/or sound an audio alarm that the bucket is heeling or that the digging portion of the work cycle is complete. Once the logic means 250 indicates that digging is complete, the operator may manually begin manual control over the work cycle, or the logic means 250 may automatically initiate the capture-load portion of the work cycle. The capture-load portion of the work cycle consists of: reducing the stick velocity to zero, raising the boom 110, and curling the bucket 120.

Once the load is captured, the logic means 250 initiates the dump-load portion of the work cycle 320 by commanding the work implement 100 to rotate toward the dump location, the boom 110 to raise, the stick 115 to reach, and the bucket 120 to uncurl, until the desired dump location is reached. After the load is dumped, the logic means 250 initiates the return-to-dig portion of the work cycle 323 by commanding the work implement 100 to rotate toward the dig location, the boom 110 to lower, and the stick 115 to reach a greater amount, until the dig location is reached. Finally, the logic means 250 initiates the boom-down-into-ground portion of the work cycle 305 by commanding the boom 110 to lower toward the ground until the bucket 120 makes contact with the ground.

Other aspects, objects and advantages of the present invention can be obtained from a study of the drawings, the disclosure and the appended claims.

I claim:

1. A control system for automatically controlling a work implement of an excavating machine through a machine work cycle, the work implement including a boom, stick and bucket, each being controllably actuated by at least one respective hydraulic cylinder, the hydraulic cylinders containing pressurized hydraulic fluid, the control system comprising:

position sensing means for producing respective position signals in response to the respective position of the boom, stick and bucket;

pressure sensing means for producing respective pressure signals in response to the associated hydraulic pressures associated with the boom, stick, and bucket hydraulic cylinders;

means for receiving the position and pressure signals, and producing a command signal;

actuating means for receiving the command signal and controllably actuating predetermined ones of the hydraulic cylinders to perform the work cycle; and logic means for determining the external force applied to the bucket and the angle of the bucket force, comparing the angle of the bucket force to a predetermined value, and responsively determining when a digging portion of the work cycle is complete.

2. A control system, as set forth in claim 1, wherein the logic means includes means for determining when the bucket is heeling in response to comparing the angle of the bucket force to a predetermined value.

3. A control system, as set forth in claim 2, including means for receiving the pressure signals and responsively computing a correlative force signal for each of the boom, stick and bucket hydraulic cylinders, wherein the command signal is produced in response to the hydraulic cylinder forces.

4. A control system, as set forth in claim 3, wherein the logic means includes means for determining the moment arm of the external force applied to the bucket relative to the point of rotation of the bucket.

5. A control system, as set forth in claim 4, including an operator interface means for displaying the external force magnitude and direction, and indicating when the bucket is heeling.

6. A method for automatically controlling a work implement of an excavating machine through a machine work cycle, the work implement including a boom, stick and bucket, each being controllably actuated by at least one respective hydraulic cylinder, the hydraulic cylinders containing pressurized hydraulic fluid, comprising the following steps:

producing respective position signals in response to the respective position of the boom, stick and bucket;

producing respective pressure signals in response to the associated hydraulic pressures associated with the boom, stick, and bucket hydraulic cylinders;

receiving the position and pressure signals, and responsively producing a command signal;

receiving the command signal and controllably actuating predetermined ones of the hydraulic cylinders to perform the work cycle; and determining an external force applied to the bucket and the angle of the bucket force, comparing the angle of the bucket force to a predetermined value, and responsively determining when a digging portion of the work cycle is complete.

7. A method, as set forth in claim 6, including the step of determining when the bucket is heeling in response to the step of comparing the angle of the bucket force to a predetermined value.

8. A method, as set forth in claim 7, including the step of receiving the pressure signals and responsively computing a correlative force signal for each of the boom, stick and bucket hydraulic cylinders, wherein the step of producing the command signal includes the step of receiving the force signals.

9. A method, as set forth in claim 8, including the step of determining the moment arm of the external force applied to the bucket relative to the point of rotation of the bucket.

10. A method, as set forth in claim 9, including the steps of displaying the external force magnitude and direction, and indicating when the bucket is heeling.

11. A control system for automatically controlling a work implement of an excavating machine through a machine work cycle, the work implement including a boom, stick and bucket, each being controllably actuated by at least one respective hydraulic cylinder, the hydraulic cylinders containing pressurized hydraulic fluid, the control system comprising:

position sensing means for producing respective position signals in response to the respective position of the boom, stick and bucket;

pressure sensing means for producing respective pressure signals in response to the associated hydraulic pressures associated with the boom, stick, and bucket hydraulic cylinders;

means for receiving the position and pressure signals, and producing a command signal;

actuating means for receiving the command signal and controllably actuating predetermined ones of the hydraulic cylinders to perform the work cycle; and logic means for determining the external force applied to the bucket and the angle of the bucket force, comparing the angle of the bucket force to a predetermined value, determining the moment arm of the external force applied to the bucket relative to the point of rotation of the bucket, and responsively determining when a digging portion of the work cycle is complete.

12. A method for automatically controlling a work implement of an excavating machine through a machine work cycle, the work implement including a boom, stick and bucket, each being controllably actuated by at least one respective hydraulic cylinder, the hydraulic cylinders containing pressurized hydraulic fluid, comprising the following steps:

producing respective position signals in response to the respective position of the boom, stick and bucket;

producing respective pressure signals in response to the associated hydraulic pressures associated with the boom, stick, and bucket hydraulic cylinders;

receiving the position and pressure signals, and responsively producing a command signal;

receiving the command signal and controllably actuating predetermined ones of the hydraulic cylinders to perform the work cycle; and determining the external force applied to the bucket and the angle of the bucket force, comparing the angle of the bucket force to a predetermined value, determining the moment arm of the external force applied to the bucket relative to the point of rotation of the bucket, and responsively determining when a digging portion of the work cycle is complete.

* * * * *